US008813320B2

(12) United States Patent
Zhao

(10) Patent No.: US 8,813,320 B2
(45) Date of Patent: Aug. 26, 2014

(54) BUCKLE FOR CHILD RESTRAINT HARNESS AND ITS OPERATING METHOD

(75) Inventor: Guang-Hui Zhao, Central Hong Kong (HK)

(73) Assignee: Wonderland Nurseygoods Company Limited, Hong Kong (HK)

( * ) Notice: Subject to any disclaimer, the term of this patent is extended or adjusted under 35 U.S.C. 154(b) by 117 days.

(21) Appl. No.: 13/291,933

(22) Filed: Nov. 8, 2011

(65) Prior Publication Data

US 2012/0110802 A1 May 10, 2012

(30) Foreign Application Priority Data

Nov. 8, 2010 (CN) ..... 2010 1 0551152

(51) Int. Cl.
*A44B 11/00* (2006.01)

(52) U.S. Cl.
USPC ..... 24/579.11; 24/DIG. 35; 24/DIG. 36; 297/468

(58) Field of Classification Search
None
See application file for complete search history.

(56) References Cited

U.S. PATENT DOCUMENTS

| | | | | |
|---|---|---|---|---|
| 312,054 | A * | 2/1885 | Williams | 24/575.1 |
| 5,432,987 | A | 7/1995 | Schroth | |
| 5,471,716 | A * | 12/1995 | Takahashi | 24/615 |
| 5,548,879 | A | 8/1996 | Wu | |
| 6,711,790 | B2 | 3/2004 | Pontaoe | |
| 2006/0070215 | A1 * | 4/2006 | Sung | 24/615 |

FOREIGN PATENT DOCUMENTS

| | | |
|---|---|---|
| EP | 1917874 B1 | 2/2010 |
| GB | 822857 | 11/1959 |
| GB | 895482 | 5/1962 |
| GB | 1351975 | 5/1974 |
| WO | 2011008935 A1 | 1/2011 |

* cited by examiner

*Primary Examiner* — Jack W. Lavinder
(74) *Attorney, Agent, or Firm* — David I. Roche; Baker & McKenzie LLP

(57) ABSTRACT

A buckle suitable for use with a child restrain harness comprises a first strap fastener having at least one resilient latching arm, a second strap fastener having a base provided with an opening, and a socket movably assembled through the opening, the socket being operable to rotate relative to the base, and the latching arm being operable to engage with the socket to securely hold the first strap fastener with the socket.

12 Claims, 6 Drawing Sheets

BUCKLE FOR CHILD RESTRAINT HARNESS AND ITS OPERATING METHOD

CROSS-REFERENCE TO RELATED APPLICATION

This application claims priority to China Patent Application No. 201010551152.2 filed on Nov. 8, 2010.

BACKGROUND OF THE INVENTION

1. Field of the Invention

The present invention relates to child restrain harness systems, and more particularly to a buckle for a child restrain harness used in infant carriers.

2. Description of the Related Art

Infant carriers (such as infant strollers, infant car seats, swing apparatuses and the like) are usually provided with a harness system to restrain movements of a child and prevent the child from falling out of the infant carrier. The harness system typically includes multiple harness straps that may be attached together via a buckle. The buckle can include a socket, and strap fasteners that are respectively connected with the ends of the harness straps and can engage with the socket to fasten the child. However, one disadvantage of the current buckles is that the ends of the harness straps may be undesirably gathered or squeezed in a limited region of the strap fasteners when the extensions of the harness straps change in direction, for example when the child is moving. As a result, stress exerted by the harness straps may be concentrated in a limited area of each strap fastener, which may cause fatigue damages of the strap fastener.

Therefore, there is a need for a buckle that can be safer in use and address at least the foregoing issues.

SUMMARY

The present application describes a buckle suitable for use with a child restrain harness and a method of operating the same. The buckle can address the problems of concentrated stress induced by gathering of the ends of the harness straps in a limited region of the strap fasteners. In one embodiment, the buckle comprises a first strap fastener having at least one resilient latching arm, a second strap fastener having a base provided with an opening, and a socket movably assembled through the opening, the socket being operable to rotate relative to the base, and the latching arm being operable to engage with the socket to securely hold the first strap fastener with the socket.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENTS

The present application describes a buckle suitable for use with a child restrain harness and its operating method. The buckle can include a rotary structure that can be adjustable according to an extension of a harness strap. As a result, the end of the harness strap can be prevented from being gathered or squeezed in a restrained area of the strap fastener, and the harness strap can be kept properly affixed with the associated fastener. Fatigue damages or breaks of the strap fastener induced by concentrated stress applied by the end of the harness strap on the strap fastener can be thereby prevented. The buckle described herein may be suitable for use with any types of infant carrier apparatuses, such as strollers, infant car seats, etc. Moreover, the buckle may be applicable to any types of child restrain harnesses, such as three-point or five-point seatbelts.

Figure 1:
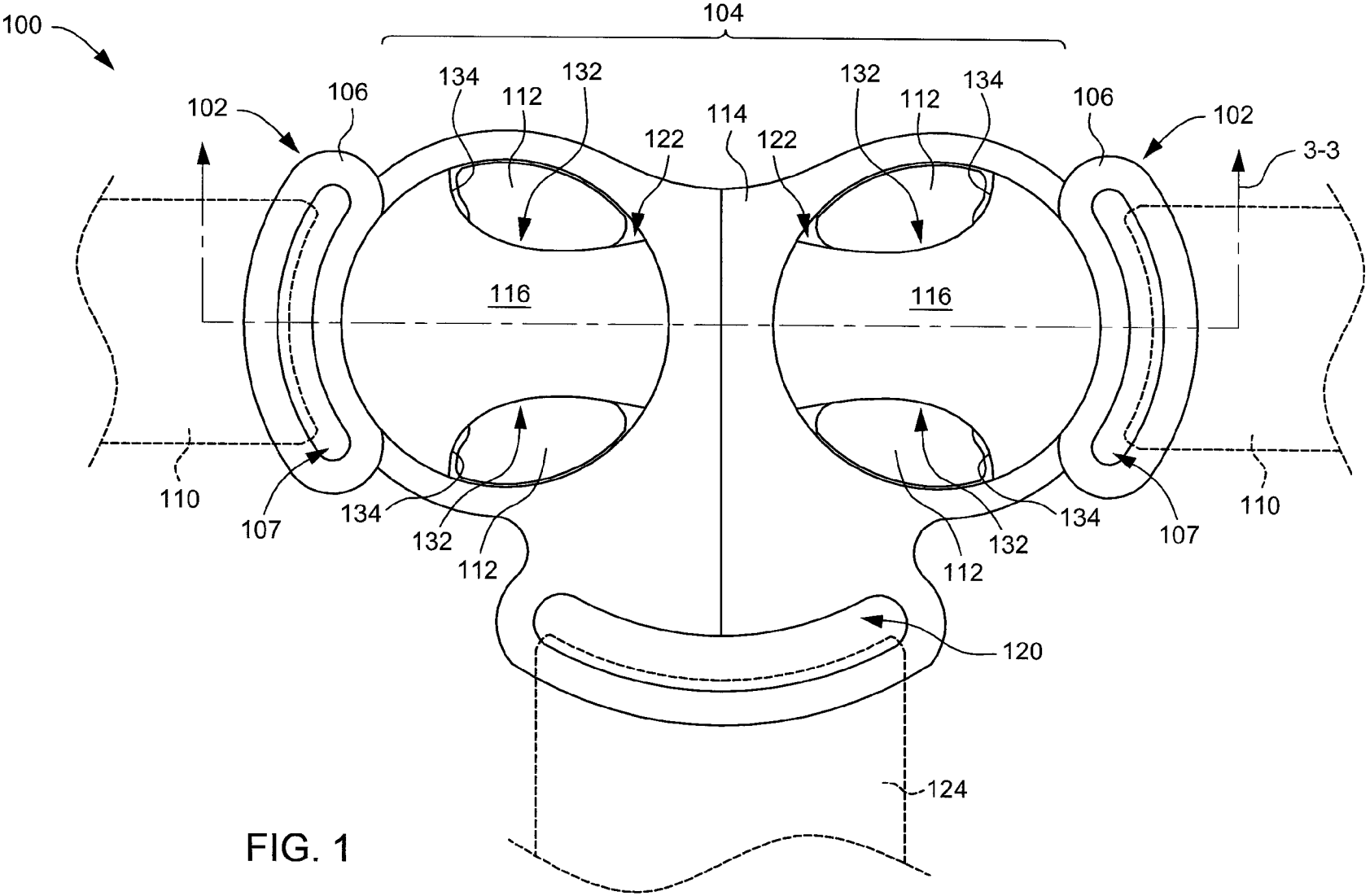
FIG. 1 is a plan view of an embodiment of a buckle suitable for use with a child restrain harness.
Figure 2:
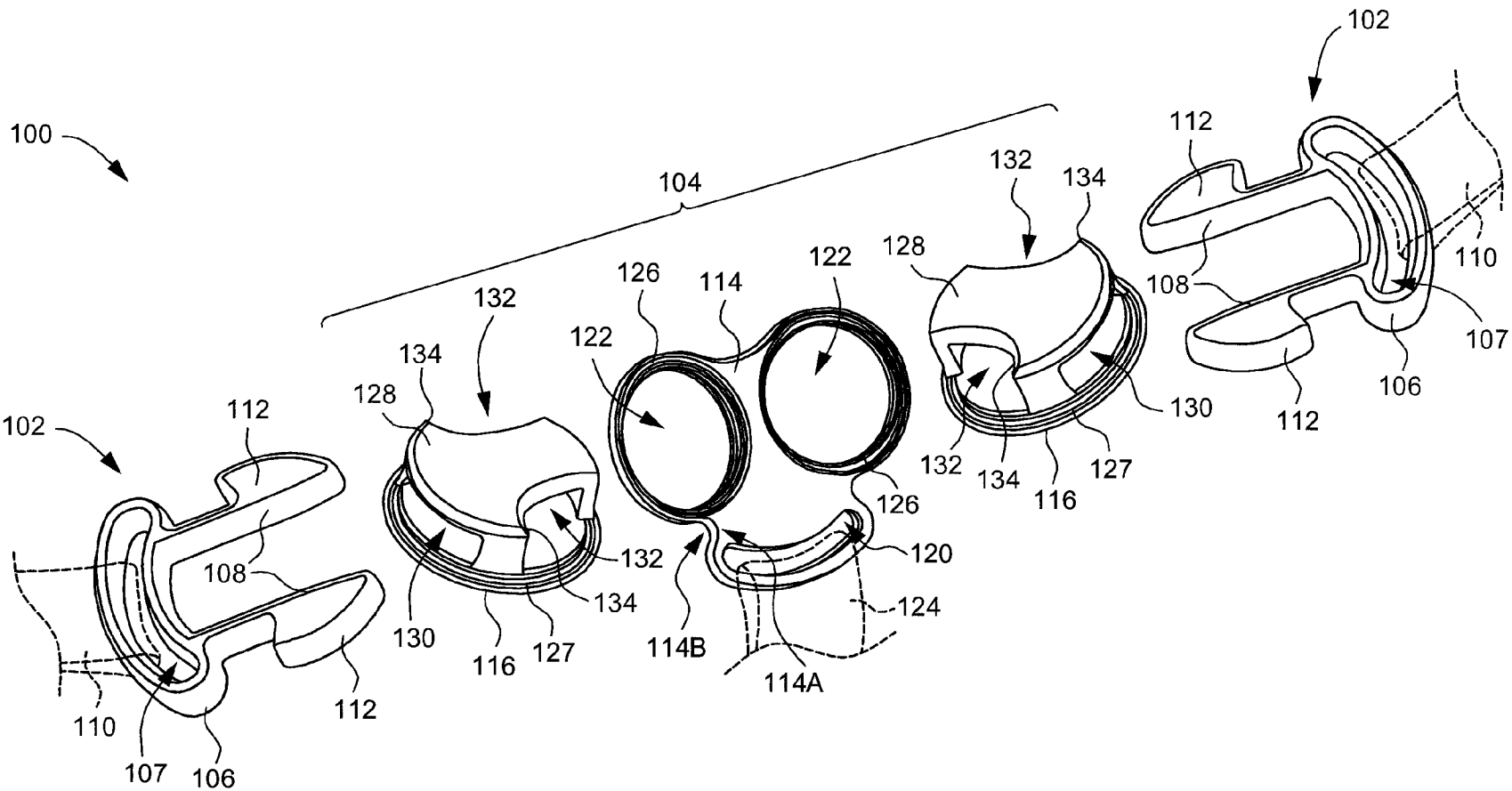
FIG. 2 is an exploded view of the buckle shown in FIG. 1.
Figure 3:
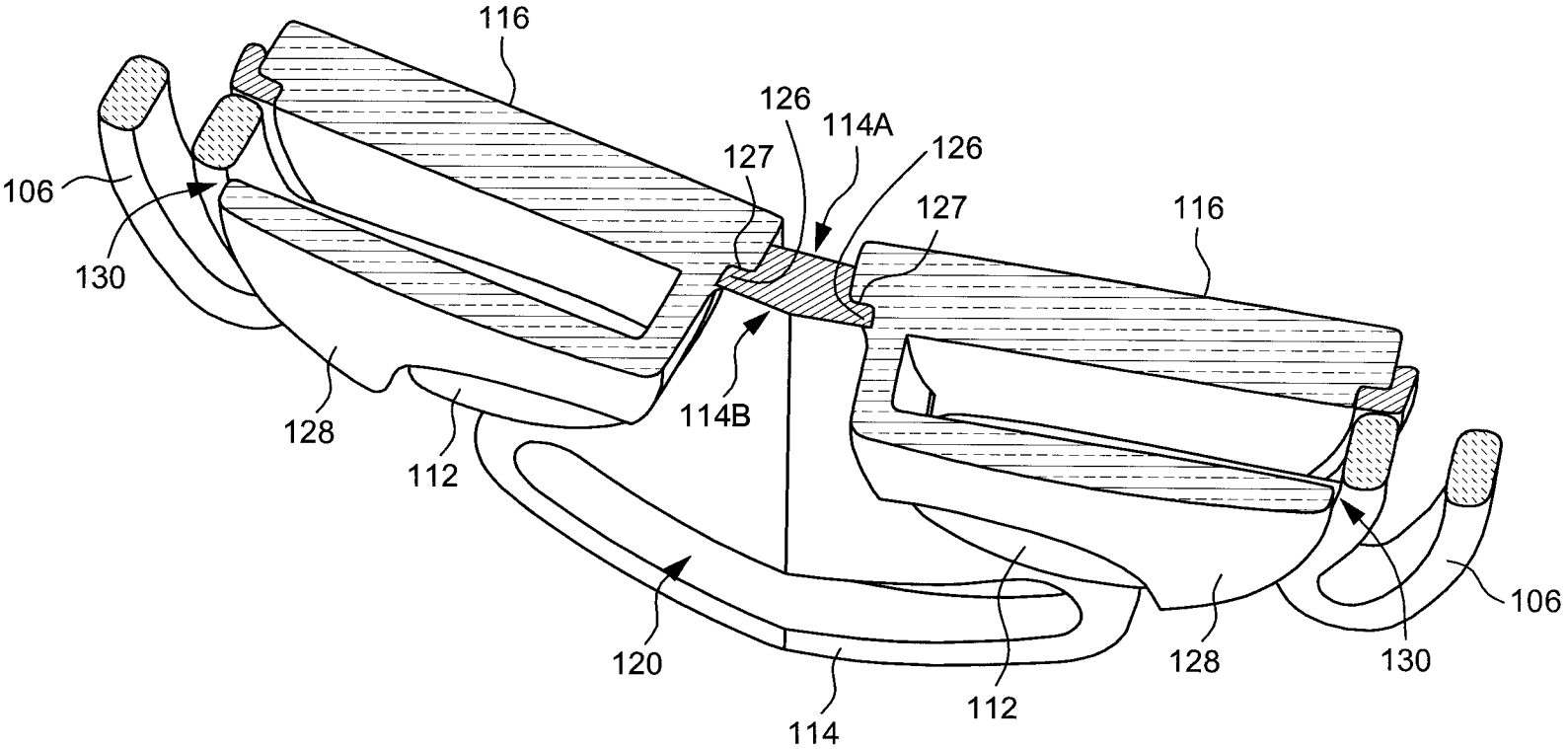
FIG. 3 is a partial cross-sectional view taken along section 3 shown in FIG. 1.
Figure 4:
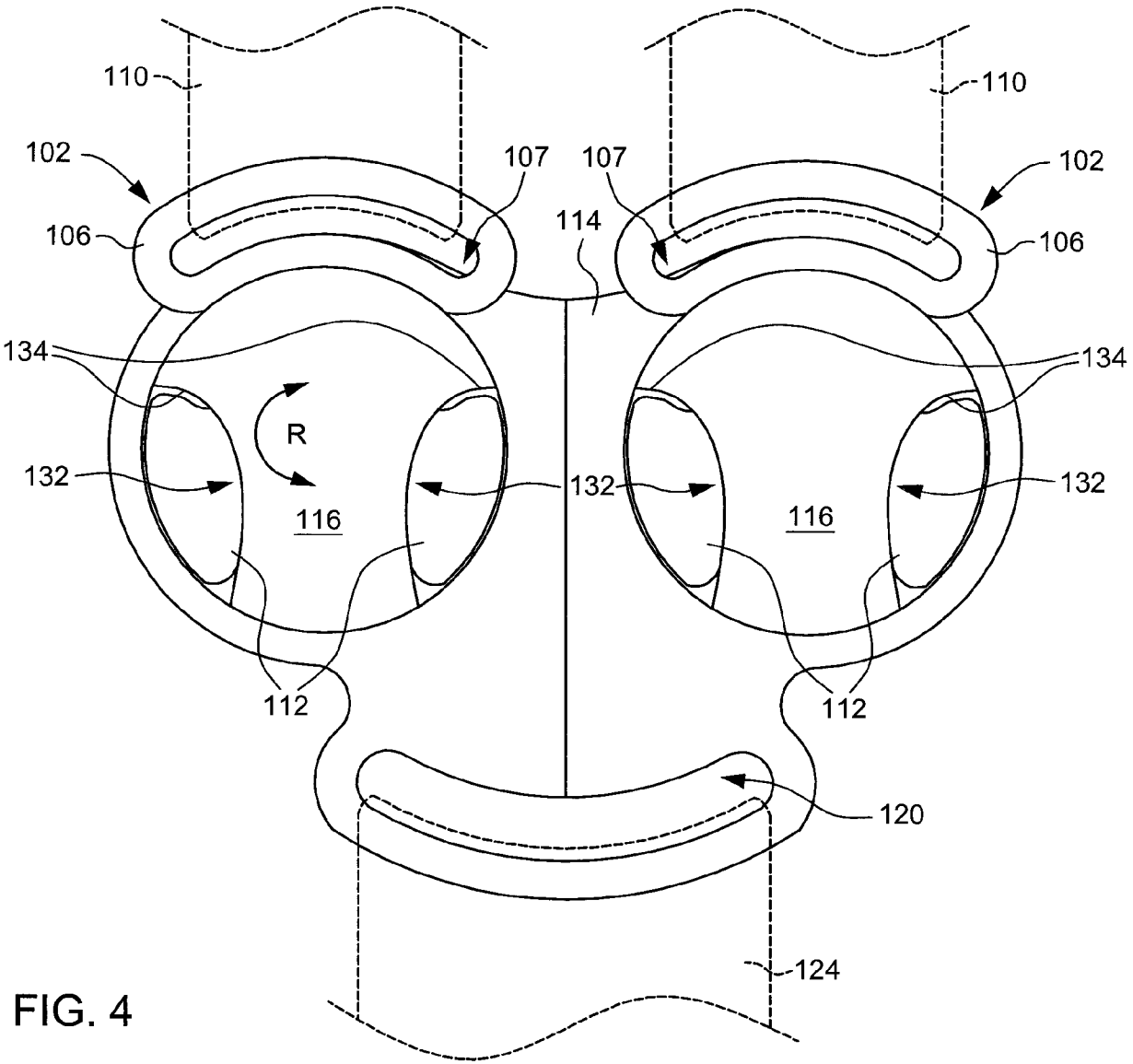
FIG. 4 is a schematic view illustrating an operation of the buckle shown in FIG. 1.

FIGS. 1-4 are schematic views illustrating one embodiment of a buckle 100 suitable for use with a child restrain harness. More specifically, FIG. 1 is a plan view of the buckle 100, FIG. 2 is an exploded view of the buckle 100, FIG. 3 is a cross-sectional view taken along section 3 shown in FIG. 1, and FIG. 4 is a schematic view illustrating an operation of the buckle 100. As shown in FIGS. 1 and 2, the buckle 100 can be exemplary applied in a three-point seatbelt including two first strap fasteners 102 and one second strap fastener 104. Each of the first strap fasteners 102 can respectively include a strap-connecting portion 106, and a plurality of resilient latching arms 108 projecting from one side of the strap-connecting portion 106. The strap-connecting portion 106 can include a hole 107 through which a first strap 110 (for example, a waist belt or shoulder belt) can be looped to connect with the first strap fastener 102. Each of the latching arms 108 can include a hook portion 112 that can engage with the second strap fastener 104 to fasten the buckle 100.

The second strap fastener 104 can include a base 114 that can be mounted with two sockets 116. In one embodiment, the base 114 can be formed as a plate having a generally flat and symmetrical shape. The base 114 can include two circular openings 122 disposed symmetrically at two sides for assembly with the sockets 116. A central region of the base 114 located between the two openings 122 can include a hole 120, which may be positioned downwardly offset from a central line joining the centers of the two circular openings 122. A second strap 124 (for example a crotch strap) can be looped through the hole 120 to connect with the second strap fastener 104. Each of the openings 122 can be formed on a first outer surface 114A of the base 114 and extend to an opposite second outer surface 114B of the base 114. An inner rim surface of each opening 122 can include a protruding flange 126 of a circular shape for achieving a pivotal connection between the base 114 and the socket 116. In one embodiment, the base 114 can be formed integrally with a rigid material, for example metal, plastics, and the like.

The socket 116 can have a generally circular contour. An outer peripheral surface of the socket 116 can include a slotted guide track 127 having a curved or circular shape. Moreover, the socket 116 can include a latch structure through which the latching arms 108 can securely engage to lock the first strap fastener 102 with the second strap fastener 104. In one embodiment, a side of the socket 116 can have a raised portion that forms a housing 128. The housing 128 has a sidewall provided with an insert slot 130, two apertures 132 and two catch flanges 134. The insert slot 130 is located on one side of the sidewall and defines an axis of insertion for the latching arms 108. The two apertures 132 and the two catch flanges 134 can be respectively disposed on two sides of the housing 128 that are opposite to each other relative to the insert slot 130. In particular, the two apertures 132 can be respectively located on two opposite sides of the axis of insertion of the latch arms 108, and the two catch flanges 134 can also be located on two opposite sides of the axis of insertion of the latch arms 108. The insert slot 130 and the apertures 132 communicate with each other through an interior of the housing 128. In one embodiment, the socket 116, including the housing 128 and the catch flanges 134, can be formed integrally from a rigid material, for example metal, plastics, and the like.

Each of the sockets 116 can be installed through one associated circular opening 122 of the base 114. More specifically, the protruding flange 126 of the base 114 can movably fit with the guide track 127 of the socket 116 to form a pivotal connection. As a result, the socket 116 can be attached with the base 114 through a pivotal connection that allows the socket 116 to rotate relative to the base 114 (as shown in FIG. 3). Once the sockets 116 and the base 114 are assembled together, the housings 128 of the sockets 116 can respectively protrude outward from the second outer surface 114B of the base 114.

Referring to FIGS. 1-3, when the latching arms 108 of the first strap fastener 102 are inserted through the insert slot 130 into the housing 128 of the socket 116, the hook portions 112 of the latching arms 108 can be respectively pushed inward by two opposite inner sidewalls of the housing 128. The latching arms 108 can continue to slide inward until the hook portions 112 respectively reach the apertures 132 and elastically recover their initial configuration to protrude through the apertures 132 and engage with the catch flanges 134. As a result, the first strap fastener 102 can be securely locked in place with the second strap fastener 104.

When the buckle 100 is unlocked by separating the first strap fastener 102 from the second strap fastener 104, the hook portions 112 of the first strap fastener 102 can be pressed inward to disengage from their respective catch flanges 134. The first strap fastener 102 then can be removed from the housing 128 of the socket 116.

As shown in FIG. 4, once the first and second strap fasteners 102 and 104 are fastened together, the first strap fastener 102 and the socket 116 can freely rotate in unison relative to the second strap fastener 104 generally parallel to the second outer surface 114B of the base 114 (as illustrated by the arrow R). The first strap fastener 102 can thereby adjust to any desirable angular direction of extension relative to the second strap fastener 104. For example, each pair of the first strap fastener 102 and the socket 116 shown in FIG. 1 is rotated 90 degrees in FIG. 4. Accordingly, the rotary adjustment structure provided in the buckle 100 can prevent the end of the harness strap from being gathered or squeezed in a limited area of the strap fastener, which may cause concentrated stress. The buckle is thus safer in use.

The adjustment structure implemented in the aforementioned buckle is not limited to three-point harness, and may also be applicable to five-point harness as described hereafter.

Figure 5:
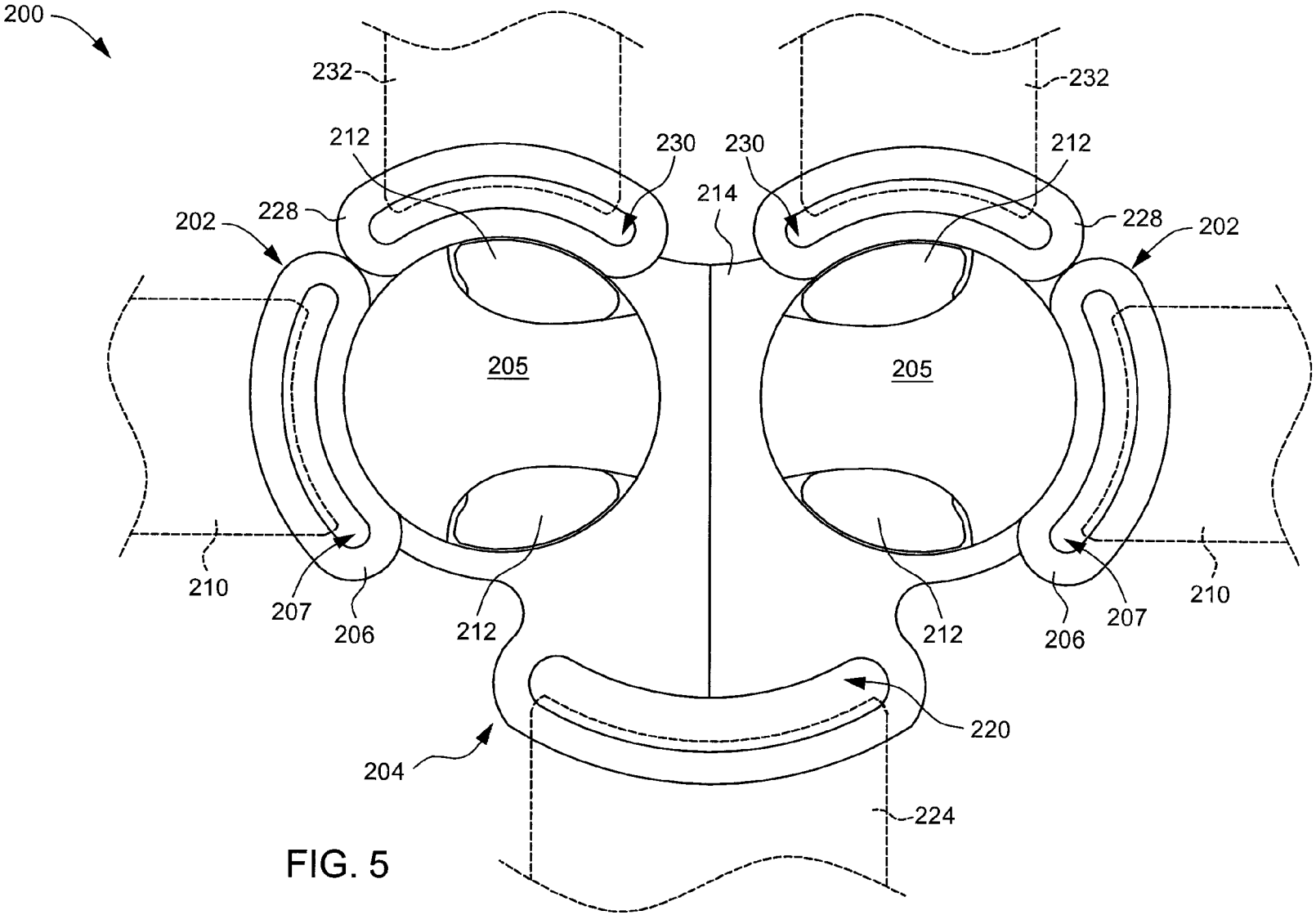
FIG. 5 is a plan view illustrating another embodiment of a buckle suitable for use with a child restrain harness.
Figure 6:
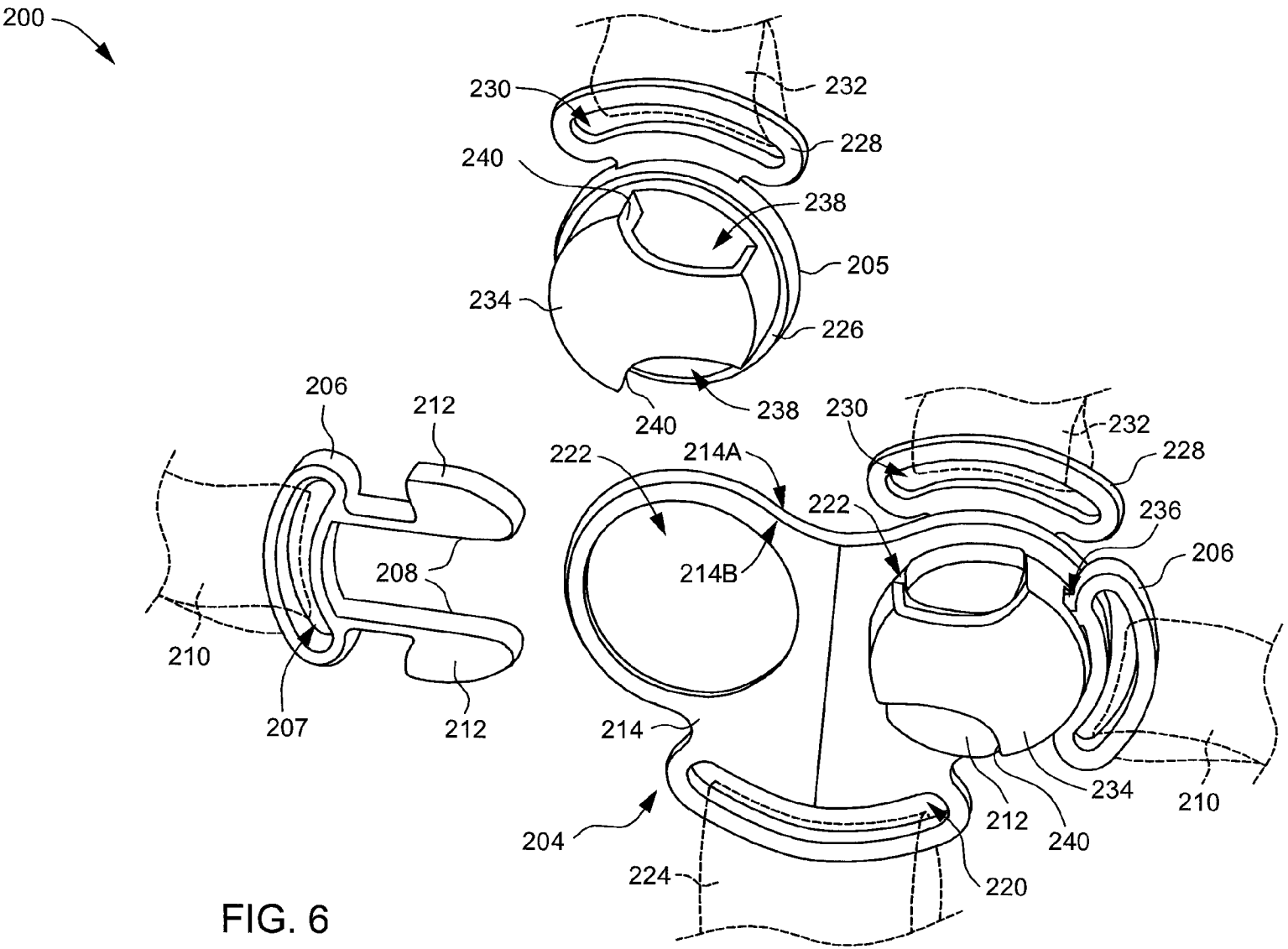
FIG. 6 is an exploded view of the buckle shown in FIG. 5.

FIGS. 5 and 6 are respectively plan view and exploded view of another embodiment of a buckle 200 that is suitable for use with a child restrain harness. As shown, the buckle 200 can be implemented in a five-point harness including two first strap fasteners 202, a second strap fastener 204 and two sockets 205. Each of the first strap fasteners 202 can respectively include a strap-connecting portion 206, and a plurality of resilient latching arms 208. The strap-connecting portion 206 can include a hole 207 through which a first strap 210 (for example, a waist belt) can be looped to connect with the first strap fastener 202. Each of the latching arms 208 can include a hook portion 212 that can engage with one associated socket 205 to securely fasten the first strap fastener 202 with the socket 205.

The second strap fastener 204 can include a base 214 formed as a plate having a generally flat and symmetrical shape. The base 214 can include two circular openings 222 disposed symmetrically at two sides for assembly with the sockets 205. A central region of the base 214 located between the two openings 222 can include a hole 220 through which a second strap 224 (for example a crotch strap) can be looped to connect with the second strap fastener 204. Each of the openings 222 can be formed on a first outer surface 214A of the base 214 and extend to an opposite second outer surface 214B of the base 214. In one embodiment, the base 214 can be formed integrally with a rigid material, for example metal, plastics, and the like.

The socket 205 can have a generally circular contour. An outer peripheral surface of the socket 205 can include a protruding flange 226, and a strap-connecting portion 228 extending in a radial direction. In one embodiment, the flange 226 may have a circular shape. The strap-connecting portion 228 can include a hole 230 through which a third strap 232 (for example, a shoulder strap) can loop to be held with the socket 205.

The socket 205 can include a raised portion that forms a housing 234 for engagement with the first strap fastener 202. The housing 234 can be formed as a raised portion having at least partially a cylindrical shape. The housing 234 can have a radius substantially equal to that of the circular opening 222, but slightly smaller than the radius of the flange 226. The housing 234 can have a sidewall provided with an insert slot 236, two apertures 238 and two catch flanges 240. The insert slot 236 is located on one side of the sidewall and defines an axis of insertion for the latching arms 208. The two apertures 238 and the two catch flanges 240 can be disposed on two sides of the housing 128 that are opposite to each other relative to the insert slot 236. In particular, the apertures 238 can be respectively located on two opposite sides of the axis of insertion of the latch arms 208, and the catch flanges 240 can also be respectively located on two opposite sides of the axis of insertion of the latch arms 208. The insert slot 236 and the apertures 238 communicate with each other through an interior of the housing 234. In one embodiment, the socket 205, including the housing 234 and the catch flanges 240, can be formed integrally from a rigid material, for example metal, plastics, and the like. The sockets 205 can be detachably mounted through the circular openings 222 of the base 214.

Referring to FIG. 6, when the buckle 200 is to be fastened, each socket 205 is first assembled through one associated opening 222 from the first outer surface 214A until the flange 226 abuts against the first outer surface 214A of the base 214. Once it is properly positioned, the socket 205 extends through the opening 222 and at least partially protrudes outward from the second outer surface 214B of the base 214. In particular, the housing 234 can protrude above the second outer surface 214B, and the socket 205 can freely rotate relative to the base 214. Subsequently, the latching arms 208 of each first strap fastener 202 can be inserted through the insert slot 236 into the housing 234 of the corresponding socket 205 at the side of the second outer surface 214B. The latching arms 208 can continue to slide inward through the interior of the housing 234 until the hook portions 212 respectively reach the apertures 238 and elastically recover their initial configuration to protrude through the apertures 238 and engage with the catch flanges 240. As a result, the first strap fastener 202 can be securely locked in place with the socket 205. Once the first strap fastener 202 is fastened with the associated socket 205, the first strap fastener 202 can be held in a position generally parallel to and overlapping with the base 214 of the second strap fastener 204. Moreover, the base 214 is located at least partially between the flange 226 of the socket 205 and the first strap fastener 202. The abutment between the flange 226 and the first outer surface 214A, and the abutment between the first strap fastener 202 and the second outer surface 214B can block displacement that may disengage the socket 205 from the opening 222. As a result, the flange 226 and the first strap fastener 202 can act to securely hold the socket 205 in place through the opening 222 of the base 214.

Once the buckle 200 is fastened, each pair of the first strap fastener 202 and the strap-connecting portion 228 of the socket 205 can freely rotate in unison relative to the base 114 in two generally parallel planes to respectively adjust to the directions of extension of the first and third straps 210 and 232. Accordingly, the buckle 200 can self adjust to substantially keep a same angle between the directions of extension of the first and third straps 210 and 232 along which the retaining forces are applied during the use of the harness. In FIG. 6, only the right-side pair of the first strap fastener 202 and the socket 205 is shown attached with the second strap fastener 204, whereas the left-side pair of the first strap fastener 202 and the socket 205 are shown in an unfastened state.

When the buckle 200 is unlocked by separating the first strap fastener 202, the second strap fastener 204 and the socket 205, the hook portions 212 of the first strap fastener 202 can be pressed inward to disengage from their respective catch flanges 240. The first strap fastener 202 then can be removed from the housing 234 of the socket 205. Once the first strap fastener 202 is detached from the socket 205, the socket 205 can be removed from the first outer surface 214A of the base 214 for complete detachment of the socket 205 from the second strap fastener 204.

With the aforementioned movable structures, the buckle can self adjust to the directions of extension of the harness straps. As a result, the buckle described herein can prevent concentrated stress induced by undesirable gathering or compression of the harness strap in a limited region of the strap fastener, which may otherwise damage or even break the strap fastener.

It is worth noting that while the socket and latch structure have been described as being formed integrally in a single part, alternate embodiments may also use the assembly of multiple elements (for example springs, sliding elements, etc.) to form the latch structure. Moreover, according to the design requirement, the base of the second strap fastener may be provided with a single or multiple circular opening and a single or multiple corresponding sockets to accommodate one or multiple first strap fasteners.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A buckle for a child restrain harness, comprising:

a first strap fastener having a plurality of resilient latching arms;

a second strap fastener having a base provided with an opening; and a socket movably assembled through the opening, the socket being operable to rotate relative to the base, and the latching arms being operable to engage with the socket to securely hold the first strap fastener with the socket, wherein the socket includes a housing having an insert slot, the latching arms being passed through the insert slot into the housing to fasten the first strap fastener with the socket.

2. The buckle according to claim 1, wherein the first strap fastener and the socket once engaged with each other are operable to rotate in unison relative to the base, the first strap fastener rotating generally parallel to the base.

3. The buckle according to claim 1, wherein each of the latching arms has a hook portion, and the housing has an aperture for receiving the hook portion and a catch flange engaging with the hook portion when the latching arm is engaged through the housing.

4. The buckle according to claim 1, wherein the opening has an inner rim surface provided with a protruding flange, and the socket has an outer peripheral surface provided with a guide track, the flange being fitted with the guide track to pivotally connect the socket with the base.

5. The buckle according to claim 1, wherein the socket is detachably assembled through the opening of the base.

6. The buckle according to claim 5, wherein the socket includes a strap-connecting portion.

7. The buckle according to claim 6, wherein the socket includes a flange, when the first strap fastener is engaged with the socket, the flange of the socket facing a first surface of the base, and the first strap fastener being positioned facing a second surface opposite to the first surface, whereby the flange and the first strap fastener being adapted to securely hold the socket in place through the opening of the base.

8. The buckle according to claim 6, wherein the first strap fastener and the socket once fastened with each other are operable to rotate in unison relative to the base, the first strap fastener and the strap-connecting portion respectively rotating in two planes generally parallel to the base.

9. A method of operating a buckle of a child restrain harness, comprising:

providing a first strap fastener connected with a first strap, the first strap fastener including a plurality of resilient latching arms;

providing a second strap fastener connected with a second strap, the second strap fastener having a base that is pivotally connected with a socket, the base being provided with an opening through which the socket is pivotally assembled, the socket including a housing having an insert slot and a plurality of apertures;

sliding the latching arms of the first strap fastener through the insert slot until the latching arms respectively engage with and are at least partially exposed at the apertures, whereby the first strap fastener is fastened with the socket; and causing the socket and the first strap fastener to rotate in unison relative to the base.

10. The method according to claim 9, wherein the first strap fastener rotates generally parallel to the base.

11. A method of operating a buckle of a child restrain harness, comprising:

providing a first strap fastener connected with a first strap;

providing a second strap fastener connected with a second strap, the second strap fastener having a base that is provided with an opening extending from a first outer surface to an opposite second outer surface of the base;

assembling a socket from the first outer surface through the opening until the socket at least partially protrudes outward from the second outer surface, wherein the socket includes a strap-connecting portion connected with a third strap; and engaging the first strap fastener with the socket at the side of the second outer surface of the base.

12. The method according to claim 11, wherein the first strap fastener and the socket are operable to rotate in unison relative to the base, the first strap fastener and the strap-connecting portion respectively rotating in two planes generally parallel to the base.

* * * * *